United States Patent [19]

Ikeda et al.

[11] Patent Number: 5,014,631

[45] Date of Patent: May 14, 1991

[54] CYCLONE FURNACE

[75] Inventors: Shiro Ikeda, Yokohama; Syoichi Yamada, Yokosuka; Satoshi Kawachi, Yokohama; Masakatsu Ishizaka, Yokosuka, all of Japan

[73] Assignee: JGC Corporation, Tokyo, Japan

[21] Appl. No.: 363,154

[22] Filed: Jun. 8, 1989

[30] Foreign Application Priority Data

Jun. 9, 1988 [JP] Japan ..... 63-142454
Jul. 22, 1988 [JP] Japan ..... 63-182847

[51] Int. Cl.[5] ..... F23D 1/02

[52] U.S. Cl. ..... 110/264; 110/347; 431/173

[58] Field of Search ..... 110/264, 347; 431/173

[56] References Cited

U.S. PATENT DOCUMENTS 2,518,800 8/1950 Lester, Sr. ..... 110/264
2,917,011 12/1959 Korner ..... 110/264
3,589,315 6/1971 Hart ..... 110/264 X
3,856,455 12/1974 Otwa et al. ..... 431/173 X
4,724,780 2/1988 Hoffert et al. ..... 110/264 X

FOREIGN PATENT DOCUMENTS 720717 12/1954 United Kingdom ..... 110/264

*Primary Examiner*—Edward G. Favors
*Attorney, Agent, or Firm*—Darby & Darby

[57] ABSTRACT

The present invention relates to a vortex type furnace for burning powder. The furnace includes a first body, at least one air-supply pipe for generating a vortex, and at least one powder-supply pipe for feeding powder to be burned in said first body. The first body includes an elongated combustion chamber of a polygonal, elliptical, or circular cross section. The first body has an axis therealong, an ignition burner at an end thereof, and an exhaust port at another end thereof. The air-supply pipe generates a vortex around the center axis in the first body. The air-supply pipe, which opens at the internal peripheral surface of said furnace, is disposed quasi-tangentially or generally colinear with the internal peripheral surface of said first body. The powder-supply pipe, which opens at the internal surface of said first body, is disposed to be spaced apart from said air-supply pipe.

4 Claims, 6 Drawing Sheets

CYCLONE FURNACE

BACKGROUND OF THE INVENTION

The present invention relates to a cyclone furnace. More specifically, it relates to a cyclone furnace that has a powder-supply pipe to feed a powder for combustion and/or melting, such as dry sludge particles, coal particles or exhaust ash, in such a fashion that the powder-supply pipe feeds the powder across a vortex or cyclone of burning gas generated by carrier gas.

Conventionally, such furnace for combusting and/or melting powders of, for example, dry sludge particles, as shown in FIG. 3, has a cylindrical furnace body 20 of a circular cross section, air-supply pipes 31A through 31D for generating an intense velocity disposed tangentially to the body 20, and powder-supply pipes 32A through 32D disposed through the air-supply pipes 31A through 31D, respectively. The powder-supply pipes 32A through 32D open in the air-supply pipes 31A through 31D, respectively, thereby conveying the powder tangentially to the vortex.

The powder is then accelerated by the air from the air-supply pipes 31A through 31D, and is carried directly thereby with little diffusion, impacts on small sections of the internal peripheral surface of the body 20. The small sections are defined by an angle $\alpha$ at approximately 17° viewed from the center axis of the furnace 20, that is, the center axis of the vortex. The powder impacts the narrow sections at a relatively large impact angle in a range of from 20° to 42°. Consequently, the small sections are eroded after a time. The rate of erosion is increased by the high temperature atmosphere in the body 20, thereby rapidly eroding the wall of the body 20 at a few points.

SUMMARY OF THE INVENTION

Accordingly, it is an object of the present invention to provide a cyclone furnace which has powder-supply pipes to feed powder across the vortex, thereby diffusing the powder to reduce the erosion of the interior body of the furnace.

It is another object of the present invention to provide a cyclone furnace, in which the ash carried by the exhaust gas can be collected, and slag generated in the furnace can be effectively removed.

In the first embodiment of the present invention, there is provided a first body, at least one air-supply pipe for generating a vortex, and at least one powder-supply pipe for feeding powder to be burned ar melted into said first body. The first body includes an elongated combustion chamber of a polygonal, elliptical, or circular cross section. The first body has an axis therealong, an ignition burner at an end thereof, and an exhaust port at the other end thereof. The air-supply pipe generates a vortex around the center axis in the first body. The air-supply pipe, which opens at the internal peripheral surface of said furnace, is disposed quasitangentially or generally colinear with the internal peripheral surface of said first body. Every powder-supply pipe which opens at the internal surface of said first body, is disposed to be spaced apart from said air-supply pipe at substantially the same elevation.

In accordance with the second embodiment of the present invention, the cyclone furnace further comprises a second body which is installed adjacent to the first body. The second body comprises a separating chamber, gas exhaustion port, slag exhaustion port, and an impact wall to which the vortex generated in the combustion chamber of the first body impacts. The separating chamber separates exhaust gas and slag from combustion products passing through the exhaust port of the first body. The separating chamber communicates with the exhaust port of the first body. The gas exhaust port is for outward exhaustion of the gas. The gas exhaust port extends upwardly from the separating chamber. The slag expulsion port is for outward expulsion of the slag. The slag expulsion port extends downwardly from the separating chamber. The wall, to which the vortex generated in the combustion chamber of the first body impacts, is disposed between the exhaust port of the first body and the separating chamber. The wall is disposed on an incline on the center axis of the first body.

DETAILED DESCRIPTION OF THE PREFERRED EMBODIMENTS

With reference to accompanying drawings, the preferred embodiments of the present invention will be described hereinafter.

FIRST EMBODIMENT

Figure 1:
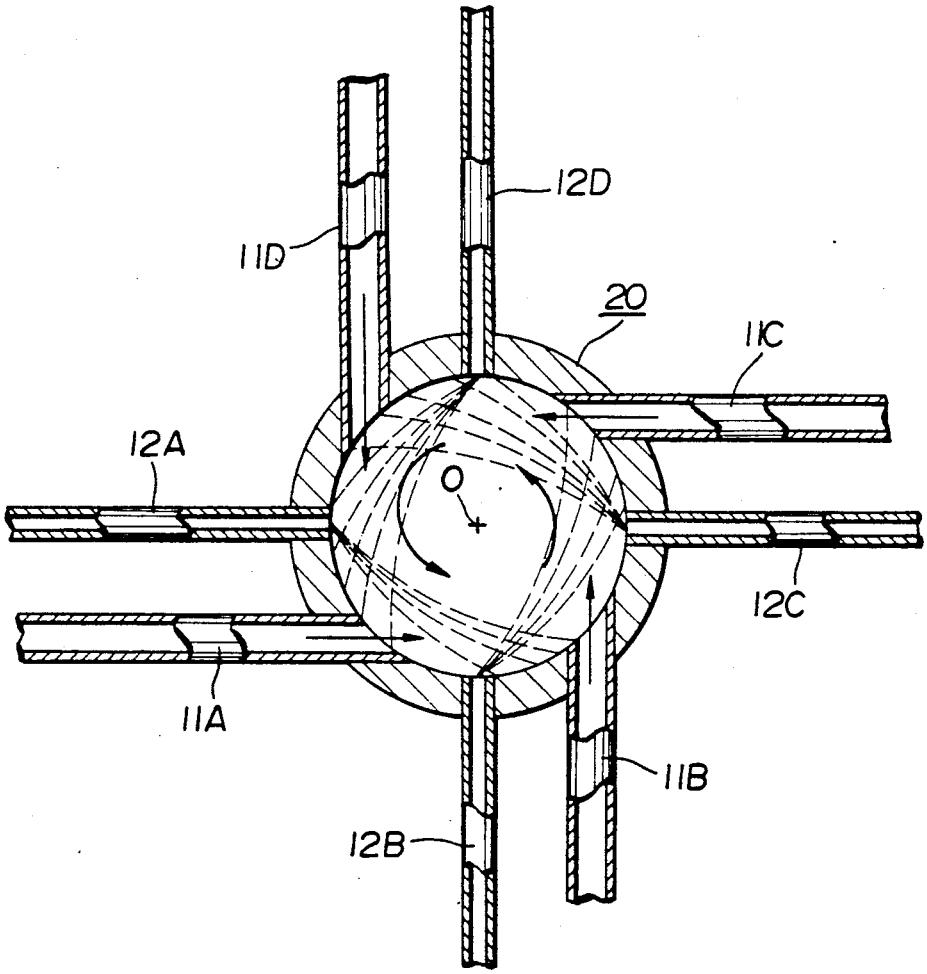
FIG. 1 is a horizontal sectional view showing a cyclone furnace according to an embodiment of the present invention.
Figure 2:
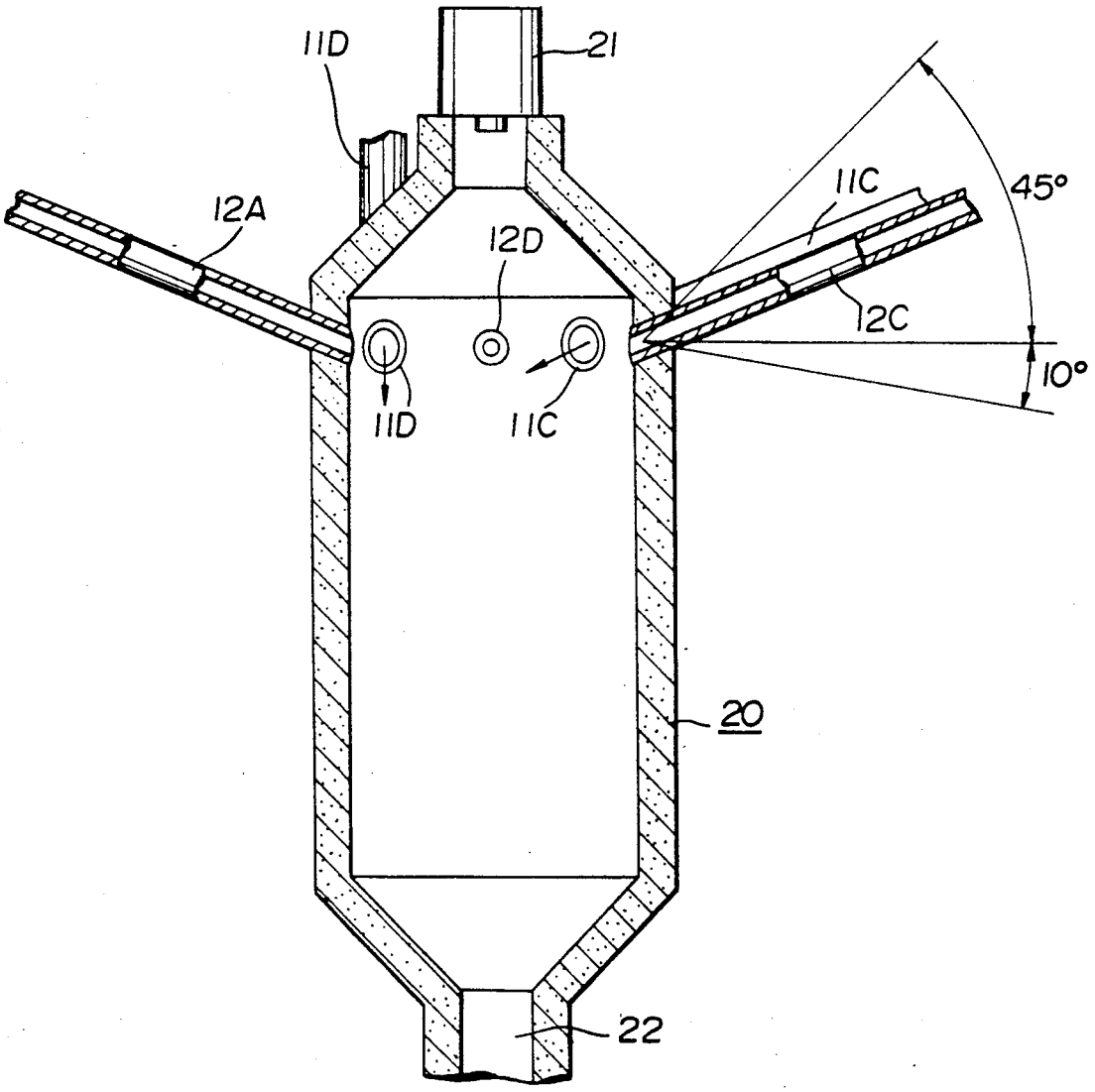
FIG. 2 is a side sectional view showing the furnace of FIG. 1.

In FIGS. 1 and 2, the furnace has a cylindrical body 20 which has an internal peripheral surface of a circular cross section; four air-supply pipes 11A through 11D, for feeding combustion air for generating vortex or cyclone in the body 20; and four powder-supply pipes 12A through 12D, for feeding a powder, such as dry sludge particle, coal particles, or burned ashes, and also for conveying air carrying the powder. Above the body 20, an ignition burner 21 for igniting the powder is equipped. Beneath the body 20, an exhaust port 22 is provided coaxially to the body 20.

The air-supply pipes 11A through 11D, which open at the internal peripheral surface of the body 20, extend tangentially from the body 20 at an inclined angle against a plane which is perpendicular to the center axis O of the vortex, the inclined angle being in a range from positive 45° to negative 10°. In the embodiment, the air-supply pipes 11A through 11D extend tangentially from the body 20 at a positively inclined angle of about 25° against the horizontal plane.

The powder-supply pipes 12A through 12D are preferably disposed beneath, or at the same level as, the air-supply pipes 11A through 11D, in order to prevent the ignition burner 21 from fouling caused by the powder. The powder-supply pipes 12A through 12D, which open at the internal peripheral surface of the body 20, also extend from the body 20 at an inclined angle against a plane which is perpendicular to the center axis O of the vortex, the inclined angle being in a range from positive 45° to negative 10°. In the embodiment, the powder-supply pipes 12A through 12D extend from the body 20 at a positive inclined angle of about 25° against the horizontal plane. In the other words, in the embodiment, the air-supply pipes 11A through 11D and the powder-supply pipes 12A through 12D were disposed at the same level, and slightly sloping downward into the body 20.

Figure 4:
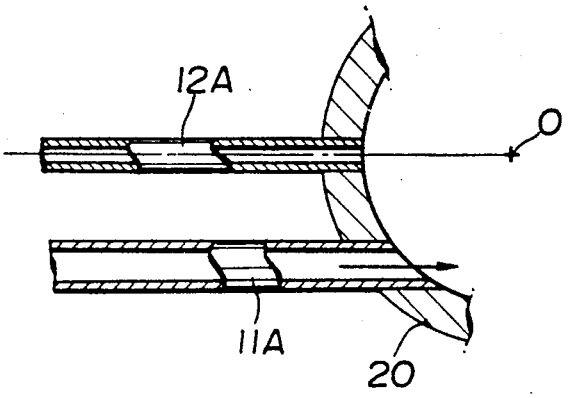
FIGS. 4 through 6 are a side sectional view showing the subject portion of the furnace shown in FIG. 1 with a powder-supply pipes variously disposed.
Figure 5:
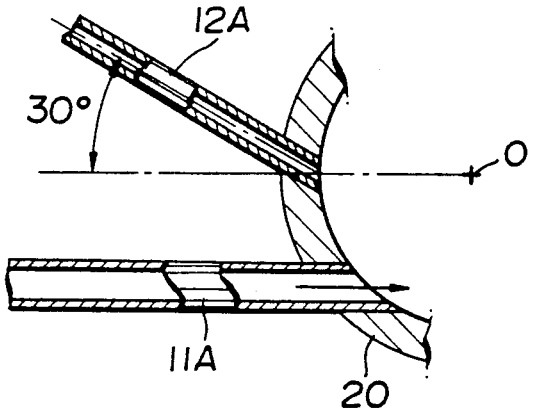
Figure 6:
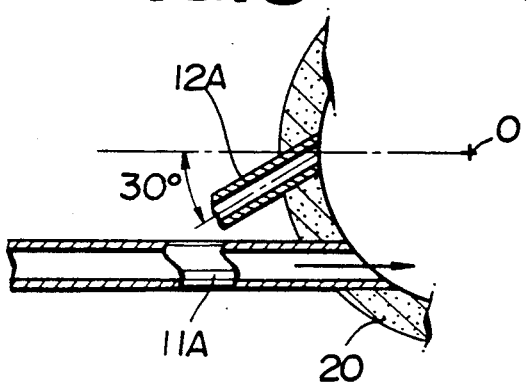

Furthermore, the powder-supply pipes 12A through 12D extend from the body 20 in such a manner that the center axes of the powder-supply pipes 12A through 12D are disposed in such a manner that the center axes of the powder-supply pipe 12A through 12D are in an angular range when reflected in a plane which is perpendicular to the center axis O of the body as shown in FIGS. 5 and 6. More specifically, each of the powder-supply pipes 12A through 12D is disposed so that when reflected in a plane perpendicular to the longitudinal axis of the first body 20, the powder-supply pipe is seen to deviate not greater than 30° from a perpendicular position to the surface of the first body 20. In the embodiment, the center axes of the powder-supply pipes 12A through 12D are with to the imaginary line (perpendicular position) as best shown in FIG. 4.

The reason the air-supply pipes 11A through 11D and the powder-supply pipes 12A through 12D must not extend at inclined angles of more than 10° in the negative direction is to prevent the ignition burner 21 from fouling caused by combustion and melting of the powder.

The reason the air-supply pipes 11A through 11D and the powder-supply pipes 12A through 12D must not extend at inclined angles exceeding positive 45° is to prevent the primary combustion zone contained in the vortex from being too near to the exhaustion port 22, thereby preventing a large temperature differential along the center axis O of the vortex.

On the other hand, the reason of the powder-supply pipes 12A through 12D are disposed as described as is as follows. If the inclined angle of the powder-supply pipes is larger than 30° in the direction shown in FIG. 6, the feeding of powder will reduce the velocity of the vortex. If the inclined angle of the powder-supply pipes is larger than 30° in the direction shown in FIG. 5, the powder will not disperse properly in the body 20, but will instead impact in a concentrated manner on the internal peripheral surface of the body 20, with large impact angles against the surface.

Operation of the furnace of the above construction is described hereinafter. As shown in FIG. 1, combustion air is fed through the air-supply pipes 11A through 11D, as designated by arrows, thereby generating the vortex around the center axis O of the body 20. The powder for combustion is fed through the powder-supply pipes 12A through 12D by means of a carrier gas, such as compressed air, inwardly to the body 20 across the vortex, thereby dispersing broadly by the vortex designated by broken lines.

The powder is burned or melted in the internal space or on the internal peripheral surface of the body 20, and produces molten slag. The molten slag adheres to the internal peripheral surface of the body 20 because of the vortex, circulates down along the surface, and is exhausted along with exhaust gases through the exhaust port 22.

Thus, the powder, for example, dry sludge particles, coal particles, or burned ashes, are sufficiently dispersed in the body 20 of the furnace. The powder can thereby be successfully burned or melted while producing a very low rate of erosion and thinning of the internal peripheral surface of the body 20.

EXAMPLE

To illustrate the present invention, a complete example of the above embodiment for burning and melting dry sludge particles generated from sewerage sludge was constructed and is described hereinafter with numerals.

The inner diameter of the body 20 was 700 mm. The inner diameter of the air-supply pipes 11A through 11D was 90 mm. The inner diameter of the powder-supply pipes 12A through 12D was 40 mm. The powder-supply pipes 12A through 12D extended radially extended from the center axis O of the body 20, and were radially spaced apart at intervals of 90°. The air-supply pipes 11A through 11D were radially spaced apart at intervals of 90°, and were disposed parallel to, and 280 mm from the powder-supply pipes 12A through 12D, respectively.

The air-supply pipes 11A through 11D and the powder-supply pipes 12A through 12D were disposed at the same level, and slightly sloping downward into the body 20.

The velocity of the air from the air-supply pipes 11A through 11D was 30 m/sec. The velocity of the carrier air from the powder-supply pipes 12A through 12D was 20 m/sec. In the body 20, the velocity of gases in the vortex ranged from 8 to 25 m/sec. Dry sludge particles had grain sizes from 60 to 600 μm.

The dry sludge particles primarily impacted on a section defined in an angle area of 70° as viewed from the center axis O of the furnace 20, of the internal peripheral surface of the body 20. The impact velocity of the dry sludge particles on the internal peripheral surface was from 4 to 12 m/sec. The impact angle of the particles was from 10° to 28° from the tangent of the internal peripheral surface.

CONVERSION

Figure 3:
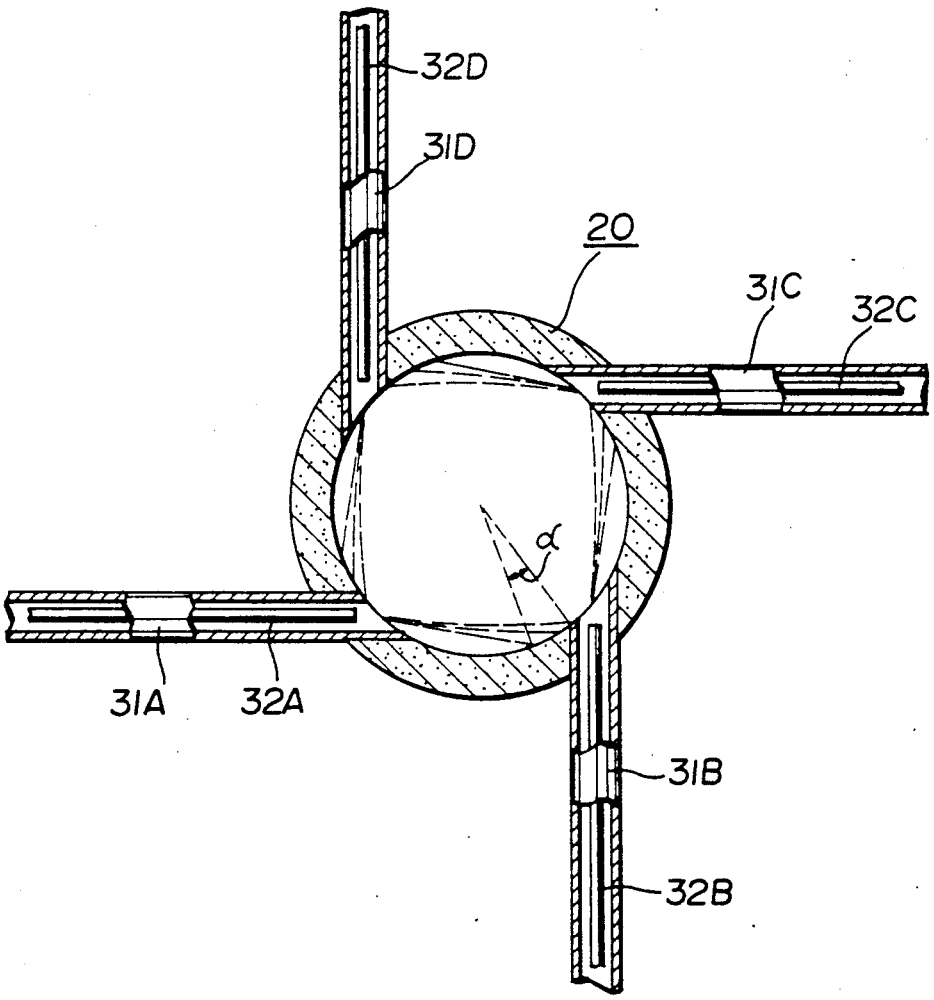
FIG. 3 PRIOR ART
FIG. 3 is a horizontally sectional view showing a cyclone furnace of prior art.

Again referring to FIG. 3, the inner diameter of the body 20 was 700 mm. The inner diameter of the air-supply pipes 31A through 31D was 100 mm. The inner diameter of the powder-supply pipes 32A through 32D was 40 mm. The air-supply pipes 31A through 31D were radially spaced at intervals of 90°, and respective disposed 280 mm from imaginary lines which passed through the center axis O of the body 20 and were parallel to the air-supply pipes 31A through 31D.

The air-supply pipes 31A through 31D and the powder-supply pipes 32A through 32D were disposed at the same level, and slightly sloping downward into the body 20.

The velocity of the combustion gas from the air-supply pipes 31A through 31D was 30 m/sec. The velocity of the carrier air from the powder-supply pipes 32A through 32D was 20 m/sec. In the body 20, the velocity of gasses in the vortex was from 8 to 23 m/sec. The dry sludge particles had grain sizes from 60 to 600 μm.

The dry sludge particles primarily impacted on a section defined by an angle area of 17° as viewed from the center axis O of the furnace 20, of the internal peripheral surface of the body 20. The impact velocity of the dry sludge particles on the internal peripheral surface was from 5 to 19 m/sec. The impact angle of the particles was from 20° to 42° from the tangential direction of the internal peripheral surface.

SECOND EMBODIMENT

Figure 7:
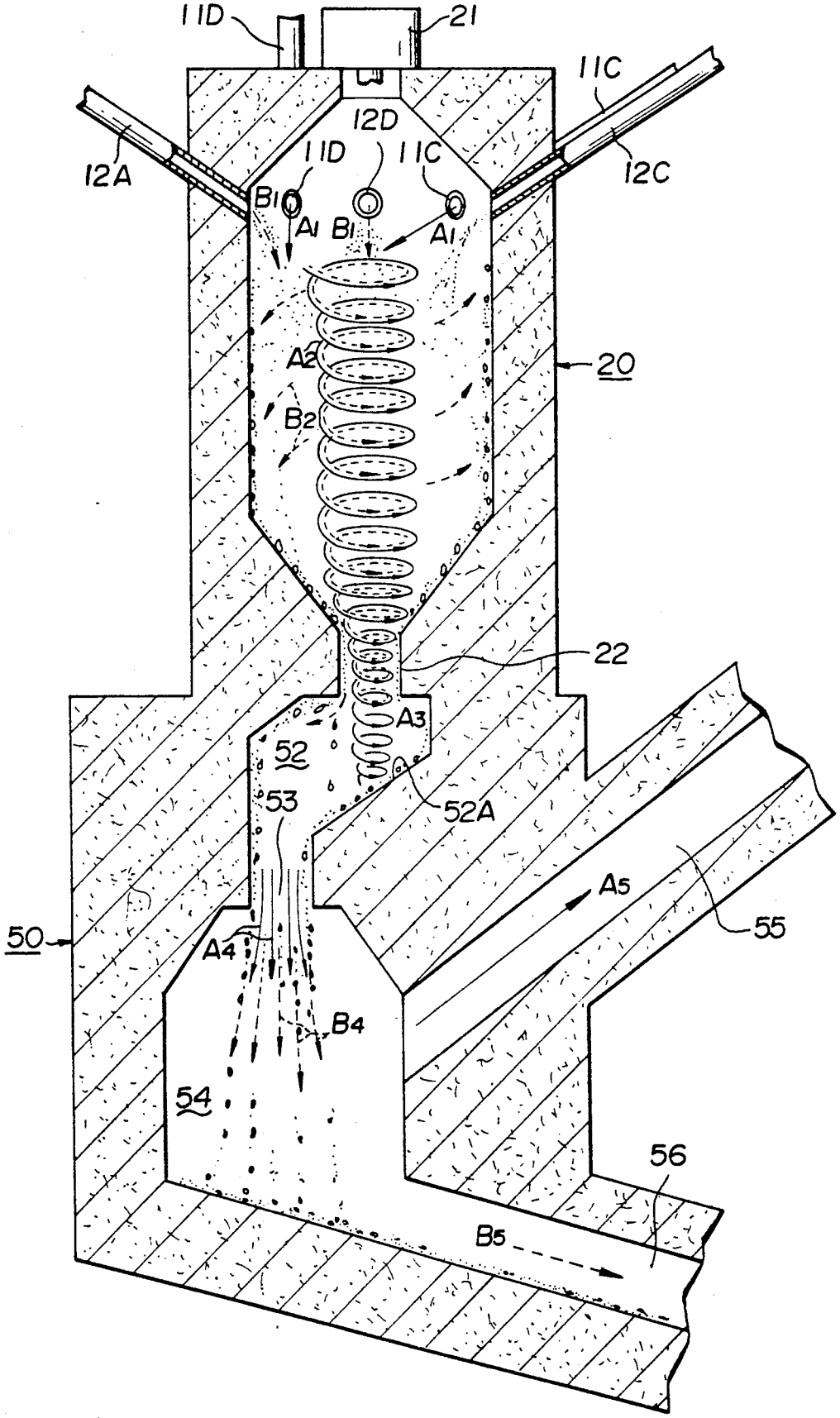
FIG. 7 is a side sectional view showing a furnace according to another embodiment of the present invention.

FIG. 7 depicts a furnace comprising a first body 20, which is similar to the body 20 of the above embodiment shown in FIGS. 1 and 2, and a second body 50 which is disposed under the body 20. The second body 50 is installed for the separation of ash, molten slag, and exhaust gases which are generated in the first body 20 and exhausted through the exhaust port 22.

The second body 50 includes a small chamber 52, passage 53, separating chamber 54, gas exhaust port 55, and slag expulsion port 56. The small chamber 52 through which the ash, molten slag, and gas pass communicates directly downwardly to the exhaust port 22. The passage 53 communicates directly downward to the small chamber 52. The separating chamber 54, for separating the ash, molten slag, and gas, communicates directly downward to the passage 53. The gas exhaust port 55 for exhaustion of the exhaust gas communicates directly to and extends upward from the separating chamber 54. The slag expulsion port 56 for exhaustion of the slag and ash communicates directly to the separating chamber 54.

The small chamber 52 is generally S-shaped, especially the bottom wall 52A directly beneath the exhaust port 22 is disposed on an incline to the center axis of the first body 20 and toward the passage 53 which is parallel to the exhaust port 22 of the first body 20. Therefore, the exhaust gas within the vortex from the exhaust port 22 impacts on the bottom wall 52A, so that the vortex is partially or completely disrupted. Therefore, the molten slag dripped from the exhaust port 22 is not carried by the vortex to the internal wall of the separating chamber 54. Furthermore, the ash included within the exhaust gas is mostly captured by the molten slag flown on the bottom wall 52A.

The separating chamber 54 has a bottom wall which is inclined to the horizontal plane for conducting the molten slag dripped from the small chamber 52 via the passage 53. The slag expulsion port 56, which is flush with the bottom wall of the separating chamber 54 thereby downwardly extending from the separating chamber 54, may communicate with a slag disposal site (not shown). The gas exhaust port 55 which is extending upward at an angle to the separating chamber 54 communicates with an apparatus (not shown) which may be, for example, a heat exchanger.

With such a construction of the furnace of the second embodiment of the present invention, the function is described hereinafter.

Combustion air for the first body 20 is fed through the air-supply pipes 11A through 11D, as indicated by arrows $A_1$. In the first body 20, the air flow $A_1$ from the air-supply pipes 11A through 11D generates the vortex $A_2$.

A powder of, for example, dry sludge particles, is fed through the powder-supply pipes 12A through 12D downward toward the center of vortex $A_2$, as indicated by arrows $B_1$. The powder is widely dispersed by the vortex $A_2$ in the first body 20, as indicated by arrows $B_2$.

The ignition burner 21 ignites a flame to start the combustion of the powder with air, so that the powder and the air burn continuously and partially melt the powder in the internal space or on the internal surface of the body 20. The burned powder produces the exhaust gases and ash to be exhausted from the exhaust port 22 by the vortex indicated by an arrow $A_3$. On the other hand, the molten powder becomes a slag which sticks to the internal surface of the body 20 because of the vortex $A_2$. The molten slag flows down on the internal surface and then is exhausted with the vortex $A_3$ through the exhaust port 22 into the small chamber 52.

The gases exhausted from the exhaust port 22 continues to spiral as indicated by arrow $A_3$. However, the vortex impacts on the bottom wall 52A so as to be partially or completely disrupted.

The ash exhausted from the exhaust port 22, carried by the exhaust gas, impacts on the bottom wall 52A. As the exhaust ash disperses in the small chamber 52, the exhaust ash is captured by the molten slag flowing on the internal wall (including the bottom wall 52A) of the small chamber 52.

Then, the exhaust gases flow into the separating chamber 54 as indicated by arrows $A_4$ so that the air speed decreases drastically and the exhaust ash settles out. Also, after the molten slag flows down on the internal wall of the small chamber 52, the molten slag drops into the separating chamber 54 through the passage 53 as indicated by arrows $B_4$. The collected slag is not dispersed to the internal peripheral wall of the separating chamber 54.

The exhaust gases are exhausted from the separating chamber 54 through the gas exhaust port 55 to the unshown apparatus which may be, for example, a heat exchanger, as indicated arrow $A_5$. The molten slag is exhausted from the separating chamber 54 through the slug expulsion port 56 to the slag disposal site, as indicated by arrow $B_5$.

According to the second embodiment, a furnace having advantages similar to those of the first embodiment is obtained. Additionally, the vortex in the exhaust gas is partially or completely disrupted, and the exhaust ash carried by the exhaust gases is captured by the molten slag, so that the rate of concentration of ash in the slag can be increased. Furthermore, the internal wall of the separating chamber 54 is sufficiently prevented from adhering or dispersing the slag. In addition, the exhaust gases can be separated from the slag and ash.

In the second embodiment, however, a means for feeding air to the second body 50 is not disclosed; a means can be installed in the second body 50 to continue the combustion even in the second body 50.

EXAMPLE

To more completely explain the second embodiment of the present invention, an example of the above embodiment for melting dry sludge particles generated from sewerage sludge is described hereinafter with numerals. The prepared dry sludge particles included ash at 30 through 50% by weight.

The inner diameter of the body 20 was 250 mm. The distance between the center axis of the exhaust port 22 and the center axis of the passage 53 was 150 mm. The air-supply pipes 11A through 11D fed the body 20 air at a flow rate equivalent to 100 to 160 $m^3$/hour at a hypothetical state of normal atmospheric pressure and room temperature. The powder-supply pipes 12A to 12D fed the powder at 7 to 15 kg/hour. The velocity of the combustion air from the exhaust port 22 was 30 to 50 m/sec.

In this example, ash at 95 through 97% within the dry sludge particles was exhausted as slag from the exhaust port 56. The gas exhausted from the gas exhaust port 55 included dust at a concentration equivalent to 0.3 through 0.7 g/m$^3$ at a hypothetical state of normal atmospheric pressure and room temperature of dry gas.

CONVERSION

Figure 8:
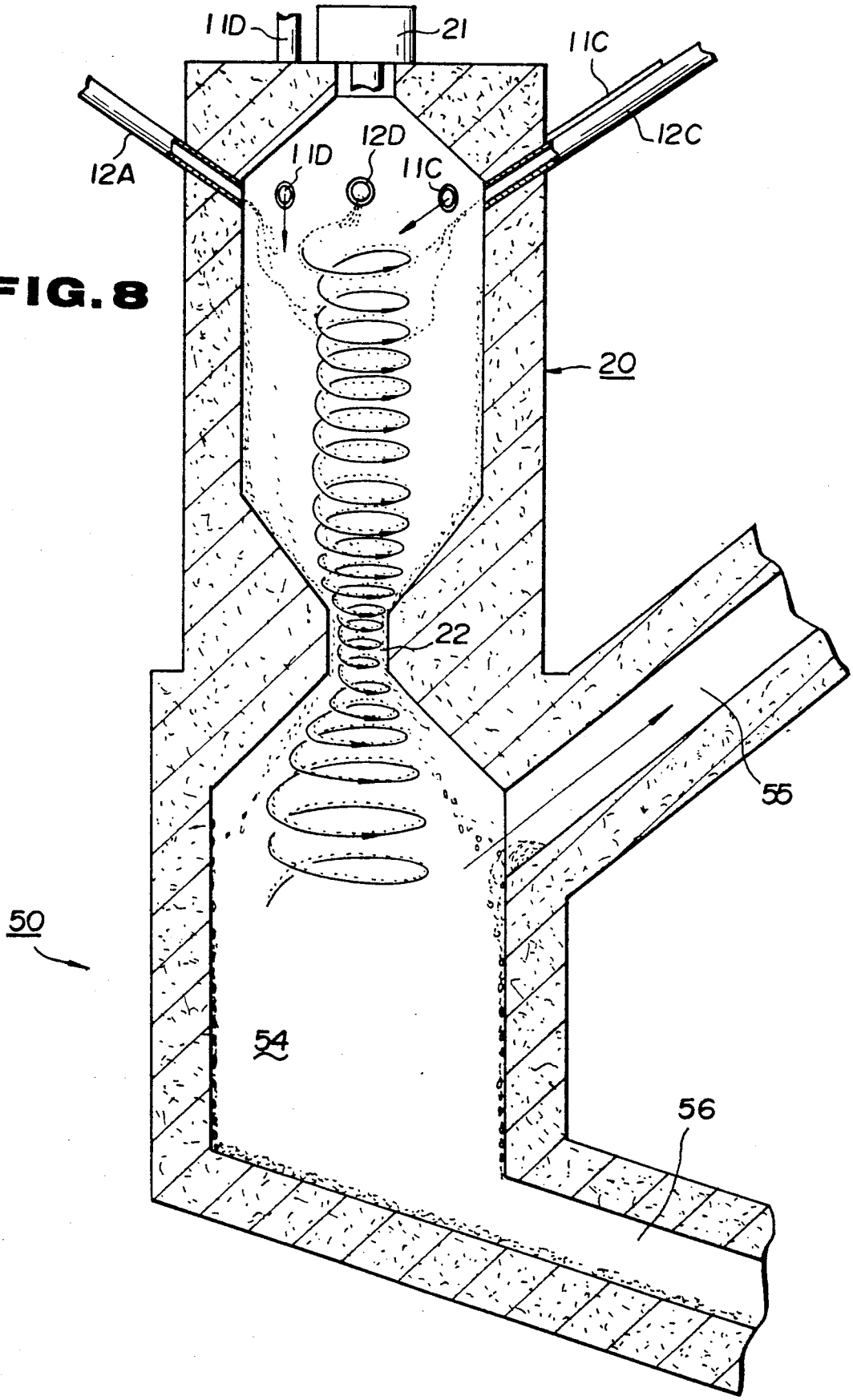
FIG. 8 is a side sectional view showing a furnace to be compared to the second embodiment.

A furnace to be compared with the above example is shown in FIG. 8. The furnace shown in FIG. 8 did not have a small chamber 52 or passage 53. The exhaust port 22 and the separating chamber 54 directly communicate with each other. The other conditions were the same as the above example.

In this result, 90 to 92 weight % ash contained in the dry sludge was exhausted as slag from the exhaust port 56. The gas exhausted from the gas exhaust port 55 included dust at a concentration equivalent to 0.5 through 1.0 g/m$^3$ at a hypothetical state of normal atmospheric pressure and room temperature of dry gas.

In a comparison between the above example and the furnace, the advantage of the second embodiment is easily understood.

What is claimed is:

1. A cyclone furnace comprising:

a first body, said first body including an elongated combustion chamber, said first body having a center axis, and having an ignition burner at one end thereof and an exhaust port at another end thereof;

at least two air-supply pipes for generating a vortex around said center axis in said first body, said air-supply pipes opening at the internal peripheral surface of said furnace and opening directly into said chamber; and at least two powder-supply pipes for feeding powder to said first body, said powder-supply pipes opening at said internal surface of said first body and opening directly into said chamber, said powder-supply pipes disposed to be spaced apart from said air-supply pipes.

2. A cyclone furnace according to claim 1, said furnace further comprising a second body which is installed adjacent to said first body, said second body comprising:

a separating chamber for separating exhaust gases and molten slag from combustion products passed through said exhaust port of said first body, said separating chamber communicating with the exhaust port of said first body;

a gas exhaust port for outward exhaustion of said gases, the gas exhaust port extending upward from said separating chamber;

a slag expulsion port for outward exhaustion of said slag, the slag expulsion port extending downward from said separating chamber; and a wall on which the circulating gases of the vortex generated in said combustion chamber of the first body impact, said wall disposed between said exhaust port of said first body and said separating chamber, said wall disposed on an incline on said center axis of said first body.

3. A cyclone furnace according to claim 1, wherein each of said powder supply pipes being disposed at an angle not more than 30° from a plane parallel to the axis of said first body and passing through a point of connection of said powder-supply pipe and said first body.

4. A cyclone furnace according to claim 3, wherein each of said powder-supply pipes being disposed at an angle to a plane perpendicular to the axis of said first body and passing through a point of intersection of said powder-supply pipe and said first body at an angle of not more than 45° toward the ignition burner and not more than 10° toward the exhaust port.

* * * * *